US010044130B2

(12) United States Patent
Zhang

(10) Patent No.: US 10,044,130 B2
(45) Date of Patent: Aug. 7, 2018

(54) ELECTRICAL CONNECTOR

(71) Applicant: Molex, LLC, Lisle, IL (US)

(72) Inventor: Xue-Hai Zhang, Kunshan (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/401,208

(22) Filed: Jan. 9, 2017

(65) Prior Publication Data

US 2017/0222353 A1 Aug. 3, 2017

(30) Foreign Application Priority Data

Feb. 1, 2016 (CN) ..... 2016 2 0101694 U

(51) Int. Cl.

| | |
|---|---|
| ***H01R 13/648*** | (2006.01) |
| ***H01R 13/504*** | (2006.01) |
| ***H01R 13/6581*** | (2011.01) |
| ***H01R 24/60*** | (2011.01) |
| ***H01R 12/70*** | (2011.01) |
| *H01R 107/00* | (2006.01) |

(52) U.S. Cl.

CPC ..... *H01R 13/504* (2013.01); *H01R 12/7082* (2013.01); *H01R 13/6581* (2013.01); *H01R 24/60* (2013.01); *H01R 2107/00* (2013.01)

(58) Field of Classification Search

CPC ..... H01R 13/658; H01R 23/688; H01R 23/6873; H01R 13/65802

USPC ..... 439/607.31, 607.04–607.09, 607.27, 439/607.37–604.38

See application file for complete search history.

(56) References Cited

U.S. PATENT DOCUMENTS

| | | | | |
|---|---|---|---|---|
| 7,837,507 | B1 * | 11/2010 | Yang | H01R 13/65802 439/607.04 |
| 7,841,901 | B2 | 11/2010 | Yu et al. | |
| 2010/0285684 | A1 * | 11/2010 | Zhang | H01R 13/6275 439/357 |

FOREIGN PATENT DOCUMENTS

| | | |
|---|---|---|
| CN | 204179333 U | 2/2015 |
| TW | M495643 U | 2/2015 |

* cited by examiner

*Primary Examiner* — Phuong Chi T Nguyen

(74) *Attorney, Agent, or Firm* — James A. O'Malley

(57) ABSTRACT

An electrical connector has an insulative body, a plurality of conductive terminals and a shielding shell. The shell is formed by first and second shielding pieces. The first piece has an annular structure provided at the front and a first semi-enclosing structure provided at the rear. The annular structure has an insertion port. The port has a front portion of a mating cavity of the connector. Two sides of the first structure each are formed with a first joint portion. The second piece has a second semi-enclosing structure. Two sides of the second piece each are formed with a second joint portion which is correspondingly fixed to and engaged with the first joint portion. The second structure and the first structure face each other in an up-down direction and are engaged with each other to enclose a tongue so as to form a rear portion of the mating cavity.

16 Claims, 6 Drawing Sheets

ELECTRICAL CONNECTOR

RELATED APPLICATIONS

This application claims priority to Chinese Application No. 201620101694.2, filed Feb. 1, 2016, which is incorporated herein by reference in its entirety.

TECHNICAL FIELD

The present disclosure relates to an electrical connector, and more specifically relates to an electrical connector in which two shielding shell pieces are combined with each other to enclose to form a mating cavity.

BACKGROUND ART

Chinese patent application No. CN201420690911.7 discloses a receptacle electrical connector for insertion of a plug electrical connector, the receptacle electrical connector comprises: an insulative body, a plurality of first terminals, a plurality of second terminals and a shielding shell. The insulative body has a base portion and a tongue extending forwardly from the base portion. Each first terminal has a first fixed portion, a first contact portion and a first soldering portion, the first fixed portion is fixed to the base portion, the first contact portion extends forwardly from the first fixed portion and is provided on a lower surface of the tongue, the first soldering portion extends outwardly from the first fixed portion and extends out of the base portion. Each second terminal has a second fixed portion, a second contact portion and a second soldering portion, the second fixed portion is fixed to the base portion, the second contact portion extends forwardly from the second fixed portion and is provided on an upper surface of the tongue, the second soldering portion extends outwardly from the second fixed portion and extends out of the base portion, the plurality of first terminals and the plurality of second terminals are arranged in a point symmetry mode. The shielding shell comprises a first shielding shell piece and a second shielding shell piece, the first shielding shell piece and the second shielding shell piece are connected and cooperate with each other to form a receiving space for receiving and enclosing the insulative body, the first shielding shell piece and/or the second shielding shell piece are provided with a plurality of soldering legs which extend outwardly, the shielding shell and the tongue cooperate with each other to form a mating space for insertion of the plug electrical connector. Because an insertion port at a front end of the shielding shell in this design is formed by the two shielding shell pieces which are stacked in an up-down direction and combined each other, a contour dimension of the insertion port is particularly easily affected by the assembling tolerance in the assembling process, which possibly makes another mating plug connector not be smoothly inserted into the receptacle electrical connector. In addition, due to the effect that an arc chamfer is formed on the shielding shell piece during stamping, the insertion port is formed with two narrow slots extending horizontally and outwardly respectively at a left connecting area and a right connecting area of the two shielding shell pieces, therefore the receptacle electrical connector having the shielding shell is difficult to tightly engage with another mating plug connector, and electromagnetic radiation is easily leaked out from the two narrow slots of the insertion port, which is difficult to meet requirements on the electromagnetic compatibility.

SUMMARY

A technical problem to be resolved by the present disclosure is to overcome the deficiency in the prior art and provide an electrical connector, which can be smoothly and tightly engaged with another mating connector, so as to meet requirements on the electromagnetic compatibility.

In view of the above technical problem, the present disclosure provides an electrical connector which comprises: an insulative body; a plurality of conductive terminals fixed to the insulative body; and a shielding shell mounted around a periphery of the insulative body. The insulative body comprises a base portion and a tongue extending forwardly from the base portion; each conductive terminal comprises a mating portion exposed on the tongue and a soldering portion extending out of the base portion; the shielding shell is formed by a first shielding shell piece and a second shielding shell piece which are combined with each other and enclose the tongue to form a mating cavity; the first shielding shell piece comprises an annular structure provided at the front and a first semi-enclosing structure provided at the rear; the annular structure encloses to form an insertion port which penetrates in a front-rear direction, the insertion port constitutes a front portion of the mating cavity; two sides of the first semi-enclosing structure are each formed with a first joint portion; the second shielding shell piece comprises a second semi-enclosing structure, two sides of the second semi-enclosing structure each are formed with a second joint portion so as to engage with the corresponding first joint portion; the second semi-enclosing structure and the first semi-enclosing structure face each other in an up-down direction and are engaged with each other to enclose the tongue so as to constitute a rear portion of the mating cavity.

In some embodiments, the annular structure comprises a bottom wall, two side walls respectively bent upwardly from two sides of the bottom wall and extending and a top wall formed by making the two side walls face other, extend relative to each other and engaged together.

In some embodiments, the top wall has an engaging slit, and one side of the engaging slit is formed with a latching protrusion which has an expanded end and a tapered neck, and the other side of the engaging slit is correspondingly provided with a latching groove for receiving the latching protrusion.

In some embodiments, the first semi-enclosing structure comprises a first main wall extending rearwardly from a bottom wall of the annular structure and two first half side walls respectively bent upwardly from two sides of the first main wall and extending, the first joint portion is further bent outwardly from a top end of the first half side wall and extends; the second shielding shell piece comprises a second main wall and two second half side walls respectively bent downwardly from two sides of the second main wall and extending, the second joint portion is further bent outwardly from a bottom end of the second half side wall and extends; a front edge of the second main wall and two front edges of the two second half side walls and a rear edge of the annular structure are attached with each other, the second joint portion and the first joint portion are attached with each other in the up-down direction.

In some embodiments, the front edge of the second main wall and the two front edges of the two second half side walls and the rear edge of the annular structure are welded together.

In some embodiments, both the first joint portion and the second joint portion extend horizontally, the second joint portion and the first joint portion are welded together.

In some embodiments, the first joint portion is provided with a first solder retaining hole which penetrates in the up-down direction, the second joint portion is provided with a second solder retaining hole which penetrates in the up-down direction, the second solder retaining hole and the first solder retaining hole are aligned with and communicated with each other in the up-down direction.

In some embodiments, a middle portion of the first joint portion is formed with a first flange protruding outwardly, the first solder retaining hole is provided to the first flange; a middle portion of the second joint portion is form with a second flange protruding outwardly, the second solder retaining hole is provided to the second flange.

In some embodiments, the second joint portion is formed with two soldering legs which are bent downwardly and extend and are spaced apart from each other in the front-rear direction.

In some embodiments, the soldering leg is provided with a solder retaining hole, the solder retaining hole extends upwardly to an upper surface of the second joint portion.

In comparison with the prior art, in the present disclosure, the annular structure is provided at the front portion of the first shielding shell piece, and the annular structure independently encloses to form the insertion port, therefore the insertion port has a precise contour dimension and is not easily affected by the assembling tolerance, and ensures another mating connector to be smoothly inserted into and tightly engaged with the electrical connector of the present disclosure, which in turn meets the requirements on the electromagnetic compatibility.

DETAILED DESCRIPTION OF THE PREFERRED EMBODIMENTS

Figure 1:
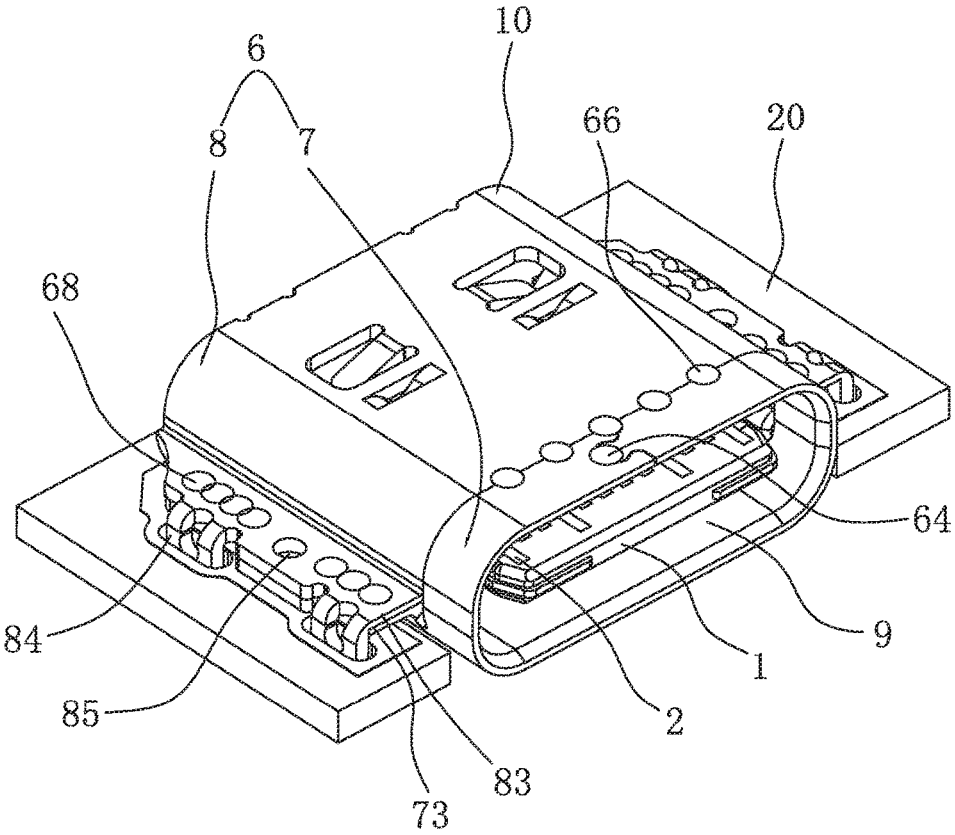
FIG. 1 is a perspective view illustrating an electrical connector of an embodiment of the present disclosure and a circuit board.
Figure 2:
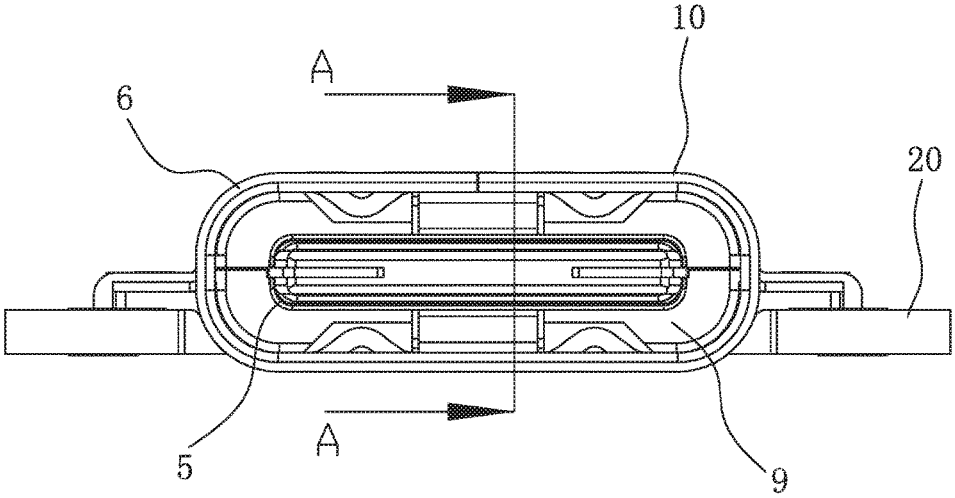
FIG. 2 is a front view illustrating the electrical connector of the embodiment of the present disclosure and the circuit board.
Figure 3:
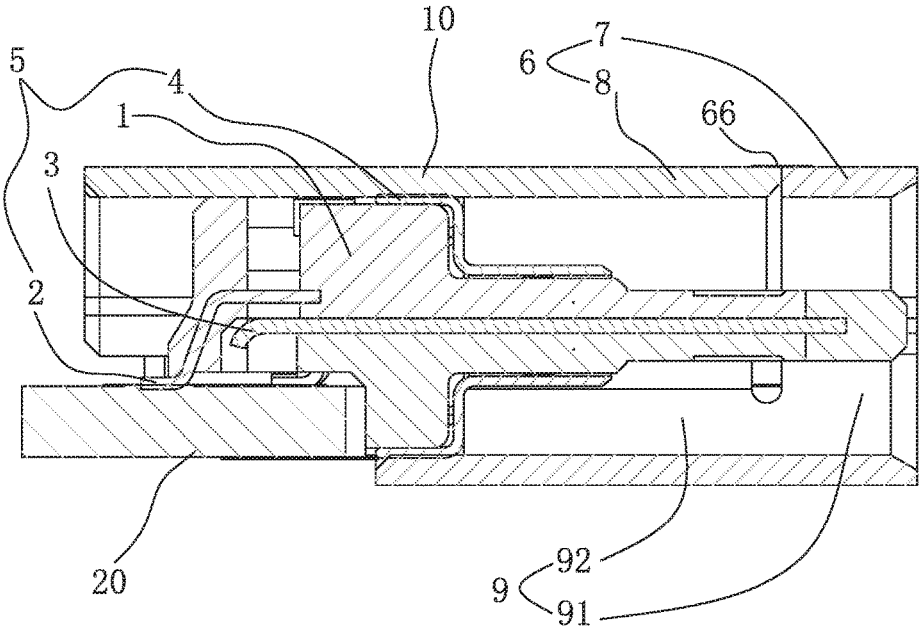
FIG. 3 is a cross sectional view taken along a line A-A of FIG. 2.
Figure 4:
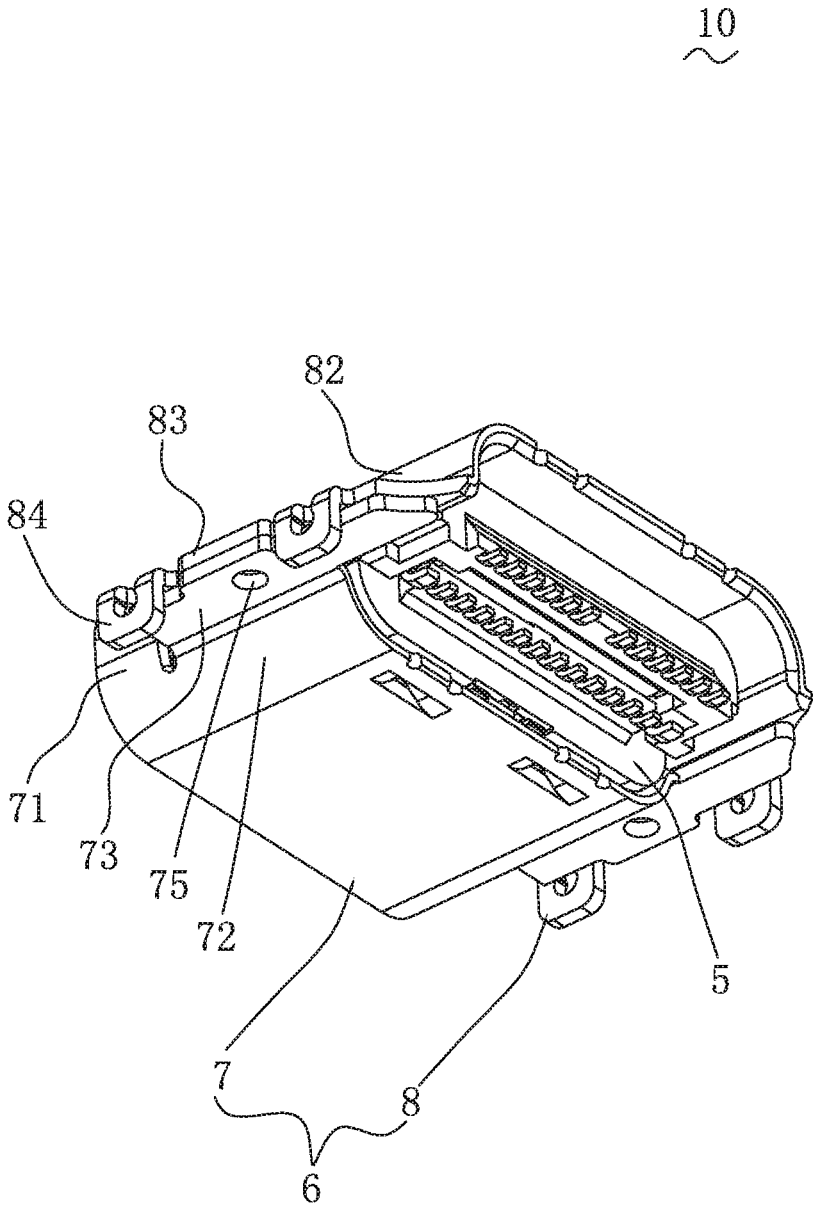
FIG. 4 is a perspective view of the electrical connector of the embodiment of the present disclosure.

While the present disclosure may be susceptible to embodiments in different forms, there are shown in Figures, and will be described herein in detail, specific embodiments, with the understanding that the present disclosure is to be considered an exemplification of the principles of the present disclosure, and is not intended to limit the present disclosure to that as illustrated.

As such, references to a feature are intended to describe a feature of an example of the present disclosure, not to imply that every embodiment thereof must have the described feature. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various parts of the present disclosure, are not absolute, but relative. These representations are appropriate when the parts are in the position shown in the Figures. If the descriptions of the positions of the parts change, however, these representations are to be changed accordingly.

Hereinafter an embodiment of the present discourse will be further described in detail in combination with the Figures.

Referring to FIG. 1 through FIG. 7, the present disclosure provides an electrical connector, an embodiment of the electrical connector is described by taking a USB Type-C electrical connector as example, the electrical connector 10 has an insulative body 1, a plurality of conductive terminals 2 fixed to the insulative body 1, a middle shielding sheet 3 fixed to the insulative body 1, two inner shielding pieces 4 mounted on the insulative body 1 and a shielding shell 6 mounted around a periphery of the insulative body 1. The insulative body 1, the plurality of conductive terminals 2, the middle shielding sheet 3 and the two inner shielding pieces 4 are combined together to form a combined main body 5. The shielding shell 6 is formed by a first shielding shell piece 7 and a second shielding shell piece 8 which are combined with each other. In the present embodiment, the electrical connector 10 is mounted on a circuit board 20 in a manner of sinking type.

The insulative body 1 comprises a base portion 18 and a tongue 19 extending forwardly from the base portion 18. In the embodiment, the insulative body 1 is formed by a first insulative piece 11 and a second insulative piece 12 which are combined with each other in an up-down direction and a third insulative piece 13 which is formed on a front end of the first insulative piece 11 and a front end of the second insulative piece 12 in a manner of inject molding. The shielding shell 6 encloses the tongue 19 so as to form a mating cavity 9.

Each conductive terminal 2 comprises a mating portion 28 exposed on the tongue 19 and a soldering portion 29 extending rearwardly out of the base portion 18. In the embodiment, the plurality of conductive terminals 2 are divided into two groups, that is, a first group of conductive terminals 21 are embedded in and engaged with the first insulative piece 11, a second group of conductive terminals 22 are embedded in and engaged with the second insulative piece 12. The mating portions 28 of the first group of conductive terminals 21 and the mating portions 28 of the second group of conductive terminals 22 are respectively exposed on an upper side surface and a lower side surface of the tongue 19.

The middle shielding sheet 3 is interposed between the first insulative piece 11 and the second insulative piece 12, and is positioned between the two groups of conductive terminals 21, 22 so as to reduce crosstalk.

The two inner shielding pieces 4 are correspondingly mounted on a front half portion of the base portion 18 of the insulative body 1 and extend forwardly to cover a rear portion of the tongue 19.

Figure 5:
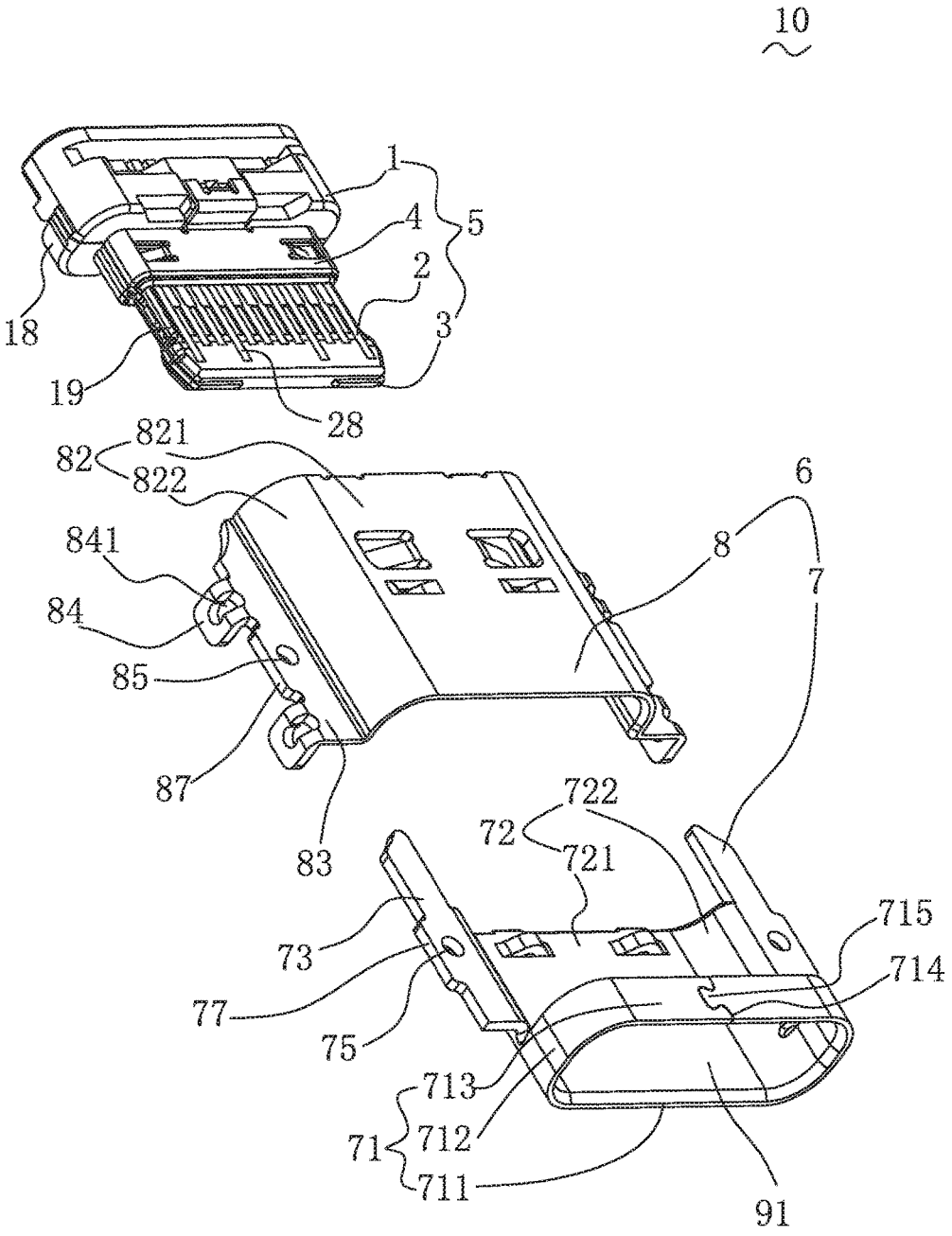
FIG. 5 is an exploded perspective view of the electrical connector of the embodiment of the present disclosure.
Figure 6:
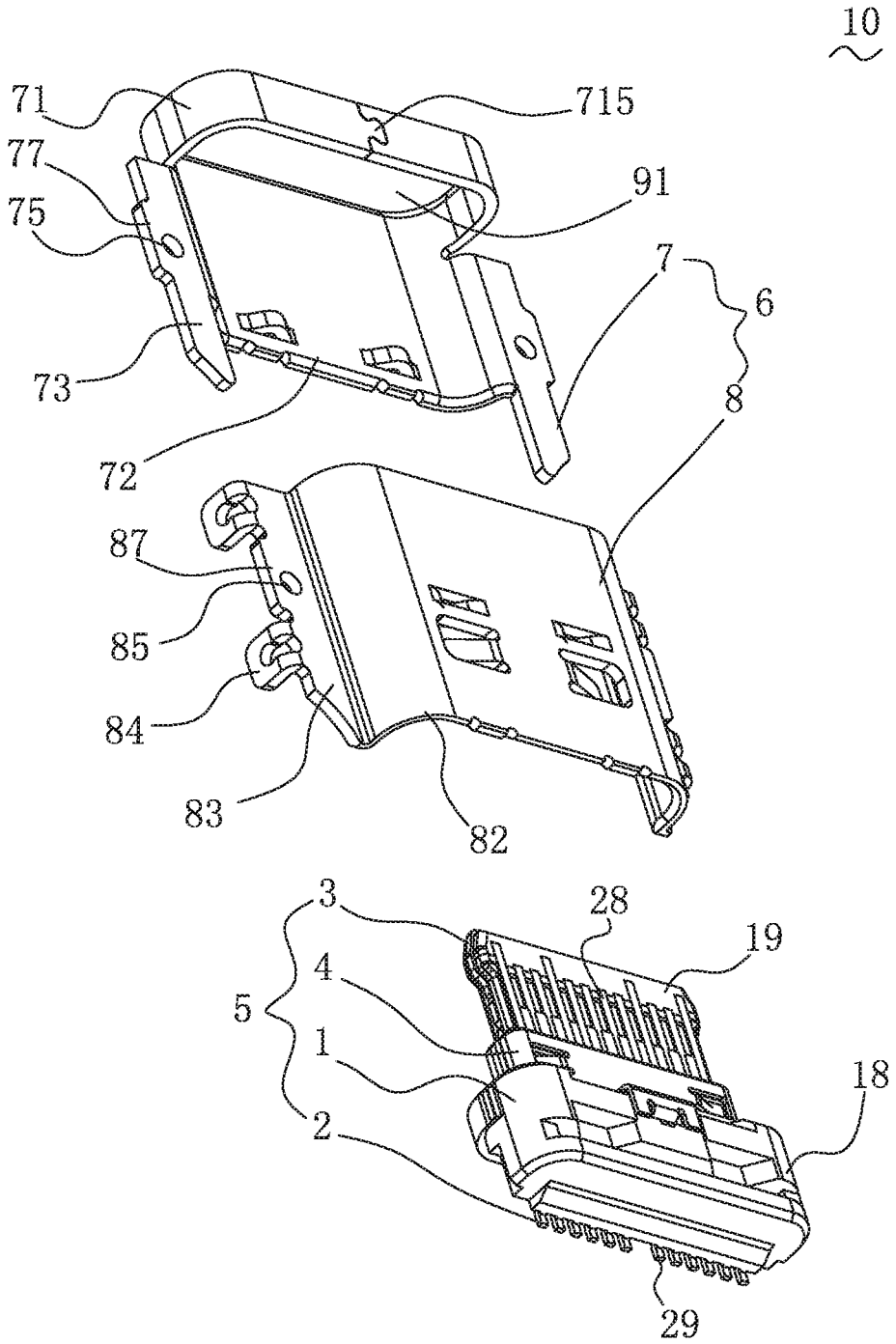
FIG. 6 is an exploded perspective view of the electrical connector of the embodiment of the present disclosure.
Figure 7:
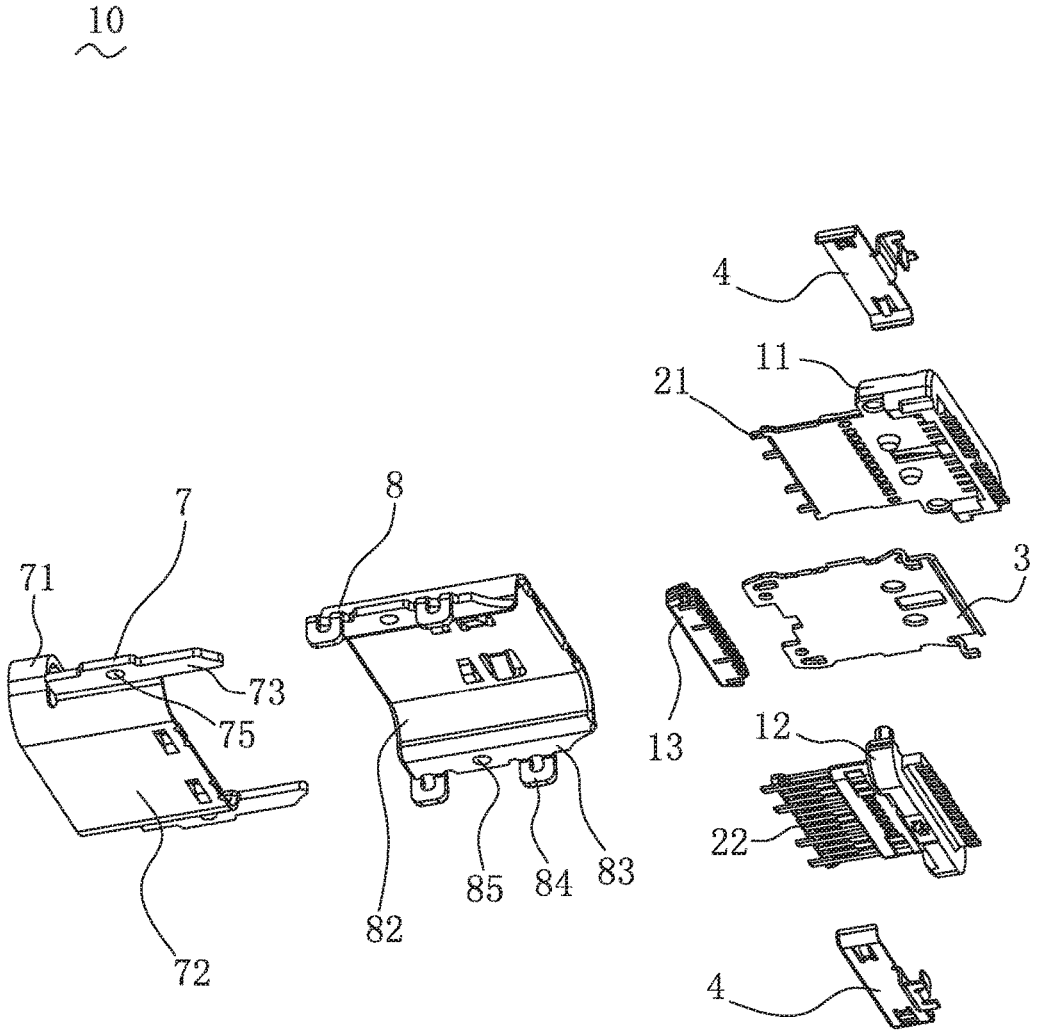
FIG. 7 is a further exploded perspective view of FIG. 6.

Referring to FIG. 5, the first shielding shell piece 7 comprises an annular structure 71 provided at the front and a first semi-enclosing structure 72 provided at the rear. The annular structure 71 encloses to form an insertion port which penetrates in a front-rear direction, the insertion port constitutes a front portion 91 of the mating cavity 9. A shape of the annular structure 71 of the embodiment is similar to an annular racetrack, and other annular structures in other embodiments which are not shown may also be circular annular, elliptical annular or even an annular structure which is approximate to a rectangle. Two sides of the first semi-enclosing structure 72 each are formed with a first joint portion 73. In the embodiment, the annular structure 71 comprises a bottom wall 711, two side walls 712 respectively bent upwardly from two sides of the bottom wall 711 and extending and a top wall 713 formed by making the two side walls 712 face other, extend relative to each other and engaged with each other. The top wall 713 has an engaging slit 714, and one side of the engaging slit 714 is formed with a latching protrusion 715 which has an expanded end and a tapered neck, and the other side of the engaging slit 714 is correspondingly provided with a latching groove for receiving the latching protrusion 715, the latching protrusion 715 is latched with the latching groove so that the latching protrusion 715 is difficult to detach from the latching groove, thereby avoiding cracking of the annular structure 71. Referring to FIG. 1, a welding joint 64 is provided on the shielding shell 6, the latching protrusion 715 and the latching groove may also be engaged together by laser welding via the welding joint 64 to further increase the joint strength. The annular structure 71 of the first shielding shell piece 7 is integrally formed by stamping with a precision mold and engaging the corresponding latching groove with the latching protrusion 715, therefore the insertion port 91 independently defined by the annular structure 71 is not easily affected by the assembling tolerance and in turn has a precise contour dimension, furthermore, narrow slots will not be formed at the left side and the right side of the insertion port as shown in the prior art, therefore the electrical connector 10 of the present disclosure can be well mated with another mating connector (not shown) to make the mating connector be smoothly inserted into the electrical connector 10 and avoid leakage of the electromagnetic radiation. The first semi-enclosing structure 72 comprises a first main wall 721 extending rearwardly from the bottom wall 711 of the annular structure 71 and two first half side walls 722 respectively bent upwardly from two sides of the first main wall 721 and extending. A first joint portion 73 is further bent outwardly from a top end of each first half side wall 722 and then extends horizontally. The first joint portion 73 is provided with a first solder retaining hole 75 which penetrates in an up-down direction. In the embodiment, a middle portion of the first joint portion 73 is formed with a first flange 77 protruding outwardly, the first solder retaining hole 75 is provided to the first flange 77.

Referring to FIG. 5, the second shielding shell piece 8 comprises a second semi-enclosing structure 82, two second joint portions 83 are respectively formed at two sides of the second semi-enclosing structure 82 so as to respectively engage with the two first joint portions 73. The second semi-enclosing structure 82 and the first semi-enclosing structure 72 face each other in the up-down direction and are engaged with each other to enclose the tongue 19, so as to form a rear portion 92 of the mating cavity 9. In the embodiment, the second semi-enclosing structure 82 comprises a second main wall 821 facing the first main wall 721 and two second half side walls 822 respectively bent downwardly from two sides of the second main wall 821 and extending. A second joint portion 83 is further bent outwardly from a bottom end of each second half side wall 822 and then extends horizontally. A front edge of the second main wall 821 and two front edges of the two second half side walls 822 and a rear edge of the annular structure 71 are attached with each other in the front-rear direction, the second joint portion 83 and the first joint portion 73 are attached with each other in the up-down direction. Referring to FIG. 1, a plurality of welding joints 66 are provided to the shielding shell 6, the front edge of the second main wall 821 and the two front edges of the two second half side walls 822 and the rear edge of the annular structure 71 are better welded together via the welding joints 66. Referring to FIG. 1, a plurality of welding joints 68 are provided to the shielding shell 6, a lower surface of the second joint portion 83 and an upper surface of the first joint portion 73 are better engaged with each other by laser welding to further increase the joint strength. The second shielding shell piece 8 and the first shielding shell piece 7 are fixed together by laser welding, therefore the mating cavity 9 only opens at the front and the periphery of the mating cavity 9 is completely sealed, which is also help to increase the electromagnetic compatibility of the electrical connector 10. The second joint portion 83 is provided with a second solder retaining hole 85 which penetrates in the up-down direction, the second solder retaining hole 85 and the first solder retaining hole 75 are aligned with and communicated with each other in the up-down direction. In the embodiment, a middle portion of the second joint portion 83 is formed with a second flange 87 protruding outwardly, the second solder retaining hole 85 is provided to the second flange 87. Furthermore, the second joint portion 83 is further formed with a soldering leg 84 bent downwardly at each of a front side and a rear side of the second flange 87 and extending, the second joint portion 83 will abut against the first joint portion 73 from above after the soldering leg 84 is soldered to the circuit board 20, which is beneficial to increase the joint strength between the second joint portion 83 and the first joint portion 73. The soldering leg 84 is provided with a solder retaining hole 841, the solder retaining hole 841 extends upwardly to an upper surface of the second joint portion 83. By providing these solder retaining holes 75, 85, 841, when the electrical connector 10 is soldered and fixed to the circuit board 20, molten solder may flow upwardly to a joint position between the first joint portion 73 and the second joint portion 83 to increase the joint strength.

An assembling process of the electrical connector 10 of the present disclosure substantially includes: preparing the combined main body 5; making the first shielding shell piece 7 and the second shielding shell piece 8 face each other in the up-down direction and mounting the first shielding shell piece 7 and the second shielding shell piece 8 onto the combined main body 5; and performing laser welding at the welding joints 64, 66, 68 as shown in FIG. 1, making the two shielding shell pieces 7, 8 engaged with each other to form an integral shielding shell 6.

In comparison with the prior art, in the present disclosure, the annular structure 71 is provided at the front portion of the first shielding shell piece 7, and the annular structure 71 independently encloses to form the insertion port 91, therefore the insertion port 91 has a precise contour dimension and ensures another mating connector to be smoothly inserted into and tightly engaged with the electrical connector 10, which in turn meets the requirements on the electromagnetic compatibility.

The above contents are only embodiments of the present disclosure and are not used to limit the implementing solution of the present disclosure, those skilled in the art may conveniently make corresponding variation or modification based on the main concept and spirit of the present disclosure, therefore the extent of protection of the present disclosure shall be determined by terms of the claims.

What is claimed is:

1. An electrical connector, comprising:

an insulative body;

a plurality of conductive terminals fixed to the insulative body; and a shielding shell mounted around a periphery of the insulative body;

the insulative body comprising a base portion and a tongue extending forwardly from the base portion;

each conductive terminal comprising a mating portion exposed on the tongue and a soldering portion extending out of the base portion;

the shielding shell being formed by a first shielding shell piece and a second shielding shell piece which are combined with each other and enclose the tongue to form a mating cavity;

the first shielding shell piece comprising an annular structure provided at a front of the first shielding shell piece and a first semi-enclosing structure provided at a rear of the first shielding shell piece;

the annular structure enclosing to form an insertion port which penetrates in a front-rear direction, the insertion port constituting a front portion of the mating cavity;

two sides of the first semi-enclosing structure being each formed with a first joint portion;

the second shielding shell piece comprising a second semi-enclosing structure, two sides of the second semi-enclosing structure each being formed with a second joint portion so as to engage with the corresponding first joint portion;

the second semi-enclosing structure and the first semi-enclosing structure facing each other in an up-down direction and being engaged with each other to enclose the tongue so as to constitute a rear portion of the mating cavity, wherein the annular structure comprises a bottom wall, two side walls respectively bent upwardly from two sides of the bottom wall and extending and a top wall formed by making the two side walls face other, extend relative to each other and engaged together, and wherein the top wall has an engaging slit, and one side of the engaging slit is formed with a latching protrusion, and the other side of the engaging slit is correspondingly provided with a latching groove for receiving the latching protrusion.

2. The electrical connector according to claim 1, wherein the latching protrusion has an expanded end and a tapered neck.

3. The electrical connector according to claim 1, wherein both the first joint portion and the second joint portion extend horizontally, the second joint portion and the first joint portion are welded together.

4. The electrical connector according to claim 1, wherein the first joint portion is provided with a first solder retaining hole which penetrates in the up-down direction, and wherein the second joint portion is provided with a second solder retaining hole which penetrates in the up-down direction, and wherein the second solder retaining hole and the first solder retaining hole are aligned with and communicated with each other in the up-down direction.

5. The electrical connector according to claim 4, wherein a middle portion of the first joint portion is formed with a first flange protruding outwardly, the first solder retaining hole is provided to the first flange, and wherein a middle portion of the second joint portion is form with a second flange protruding outwardly, the second solder retaining hole is provided to the second flange.

6. The electrical connector according to claim 1, wherein the second joint portion is formed with two soldering legs which are bent downwardly and extend and are spaced apart from each other in the front-rear direction.

7. The electrical connector according to claim 6, wherein the soldering leg is provided with a solder retaining hole, the solder retaining hole extends upwardly to an upper surface of the second joint portion.

8. An electrical connector, comprising:

an insulative body;

a plurality of conductive terminals fixed to the insulative body; and a shielding shell mounted around a periphery of the insulative body;

the insulative body comprising a base portion and a tongue extending forwardly from the base portion;

each conductive terminal comprising a mating portion exposed on the tongue and a soldering portion extending out of the base portion;

the shielding shell being formed by a first shielding shell piece and a second shielding shell piece which are combined with each other and enclose the tongue to form a mating cavity;

the first shielding shell piece comprising an annular structure provided at a front of the first shielding shell piece and a first semi-enclosing structure provided at a rear of the first shielding shell piece;

the annular structure enclosing to form an insertion port which penetrates in a front-rear direction, the insertion port constituting a front portion of the mating cavity;

two sides of the first semi-enclosing structure being each formed with a first joint portion;

the second shielding shell piece comprising a second semi-enclosing structure, two sides of the second semi-enclosing structure each being formed with a second joint portion so as to engage with the corresponding first joint portion;

the second semi-enclosing structure and the first semi-enclosing structure facing each other in an up-down direction and being engaged with each other to enclose the tongue so as to constitute a rear portion of the mating cavity, wherein the annular structure comprises a bottom wall, two side walls respectively bent upwardly from two sides of the bottom wall and extending and a top wall formed by making the two side walls face other, extend relative to each other and engaged together, and wherein the first semi-enclosing structure comprises a first main wall extending rearwardly from the bottom wall of the annular structure and two first half side walls respectively bent upwardly from two sides of the first main wall and extending, the first joint portion is further bent outwardly from a top end of the first half side wall and extends, and wherein the second shielding shell piece comprises a second main wall and two second half side walls respectively bent downwardly from two sides of the second main wall and extending, the second joint portion is further bent outwardly from a bottom end of the second half side wall and extends, and wherein a front edge of the second main wall and two front edges of the two second half side walls and a rear edge of the annular structure are attached with each other, the second joint portion and the first joint portion are attached with each other in the up-down direction.

9. The electrical connector according to claim 8, wherein the front edge of the second main wall and the two front edges of the two second half side walls and the rear edge of the annular structure are welded together.

10. The electrical connector according to claim 8, wherein both the first joint portion and the second joint portion extend horizontally, the second joint portion and the first joint portion are welded together.

11. The electrical connector according to claim 8, wherein the first joint portion is provided with a first solder retaining hole which penetrates in the up-down direction, and wherein the second joint portion is provided with a second solder retaining hole which penetrates in the up-down direction, and wherein the second solder retaining hole and the first solder retaining hole are aligned with and communicated with each other in the up-down direction.

12. The electrical connector according to claim 11, wherein a middle portion of the first joint portion is formed with a first flange protruding outwardly, the first solder retaining hole is provided to the first flange, and wherein a middle portion of the second joint portion is form with a second flange protruding outwardly, the second solder retaining hole is provided to the second flange.

13. The electrical connector according to claim 8, wherein the second joint portion is formed with two soldering legs which are bent downwardly and extend and are spaced apart from each other in the front-rear direction.

14. The electrical connector according to claim 13, wherein the soldering leg is provided with a solder retaining hole, the solder retaining hole extends upwardly to an upper surface of the second joint portion.

15. The electrical connector according to claim 8, wherein the top wall has an engaging slit, and one side of the engaging slit is formed with a latching protrusion, and the other side of the engaging slit is correspondingly provided with a latching groove for receiving the latching protrusion.

16. The electrical connector according to claim 15, wherein the latching protrusion has an expanded end and a tapered neck.

* * * * *